US006978031B2

(12) United States Patent
Garretson et al.

(10) Patent No.: US 6,978,031 B2
(45) Date of Patent: Dec. 20, 2005

(54) LOUDSPEAKER SOUND MODULATION APPARATUS

(75) Inventors: Joseph K. Garretson, Oxnard, CA (US); Lewis C. Iby, Westlake Village, CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

(21) Appl. No.: 10/851,420

(22) Filed: May 24, 2004

(65) Prior Publication Data

US 2005/0213784 A1 Sep. 29, 2005

Related U.S. Application Data

(63) Continuation-in-part of application No. 10/807,041, filed on Mar. 23, 2004.

(51) Int. Cl.[7] ..... H04R 25/00

(52) U.S. Cl. ..... 381/162; 381/165; 381/386; 381/189

(58) Field of Search ..... 381/62, 150, 161, 381/162, 164, 165, 189, 386, 396; 40/431, 40/433; 362/257, 279; 181/143, 181, 171

(56) References Cited

U.S. PATENT DOCUMENTS 3,902,015 A * 8/1975 Edwards et al. ..... 381/62
4,817,163 A * 3/1989 Stastny ..... 381/150

* cited by examiner

*Primary Examiner*—Huyen Le
(74) *Attorney, Agent, or Firm*—William W. Haefliger

(57) ABSTRACT

A loudspeaker assembly includes a speaker diaphragm that is displaced to produce sound, and a spinner element mounted to rotate in the path of sound waves produced by the speaker diaphragm, the spinner defining sound wave passing through openings, in said path. Illumination of interior structure, may be provided, for visual effect through openings defined between rotating spinner arms, and between non-rotating grille arms. Different combinations of grilles and spinners are easily enabled by mounting structure.

12 Claims, 7 Drawing Sheets

LOUDSPEAKER SOUND MODULATION APPARATUS

This application is a CIP of Ser. No. 10/807,401, filed Mar. 23, 2004.

BACKGROUND OF THE INVENTION

This invention relates generally to accessories to loudspeakers, as for example are used in the instrument panels of vehicles, or for other purposes. More particularly it concerns a rotating element or spinner positioned in the path of sound waves produced by the speaker.

There is need for loudspeaker accessories characterized as producing motion to complement the sound, such as music, produced by such speakers.

SUMMARY OF THE INVENTION

It is a major object of the invention to provide a moving accessory meeting the above need, and which can be integrated with the speaker or its cabinet or housing.

In this regard, the invention is provided by:

a) a spinner element mounted to rotate in the path of sound waves produced by the speaker diaphragm; and b) a rotary drive for rotating the spinner, c) the spinner defining sound wave passing through openings, in said path.

As will be seen, the spinner may comprise a disc substantially spanning the sound wave path, to provide for sound wave modulation.

A further object is to provide a spinner that includes:

i) a hub, and ii) spaced apart arms extending outwardly from said hub.

As will be seen the arms may have spaced apart extents between which the openings are formed.

Another object is to provide for illuminations of structure visible through a rotary spinner and a non-rotating guide; and to provide for various spinners and grille combinations, to vary visual effect and sound modulations.

Another object is to provide a drive to comprise an electric motor positioned between said diaphragm and said spinner. The motor is typically positioned between said diaphragm and said hub, and operatively connected to the hub. The motor is preferably carried by an interior support carried by a front plate defined by the loudspeaker assembly.

An added object is to provide speaker arms having varying widths along arm lengths which extend generally radially. The arms may typically rotate the spinner at a speed causing audible modulation of said sound waves passing through the openings, between the arms. The diaphragm of the speaker is typically a woofer producing low frequency sound waves that are "chopped" by the spinner, the concave side of the woofer facing toward the spinner.

These and other objects and advantages of the invention, as well as the details of an illustrative embodiment, will be more fully understood from the following specification and drawings, in which:

DRAWING DESCRIPTION

DETAILED DESCRIPTION

Figure 1:
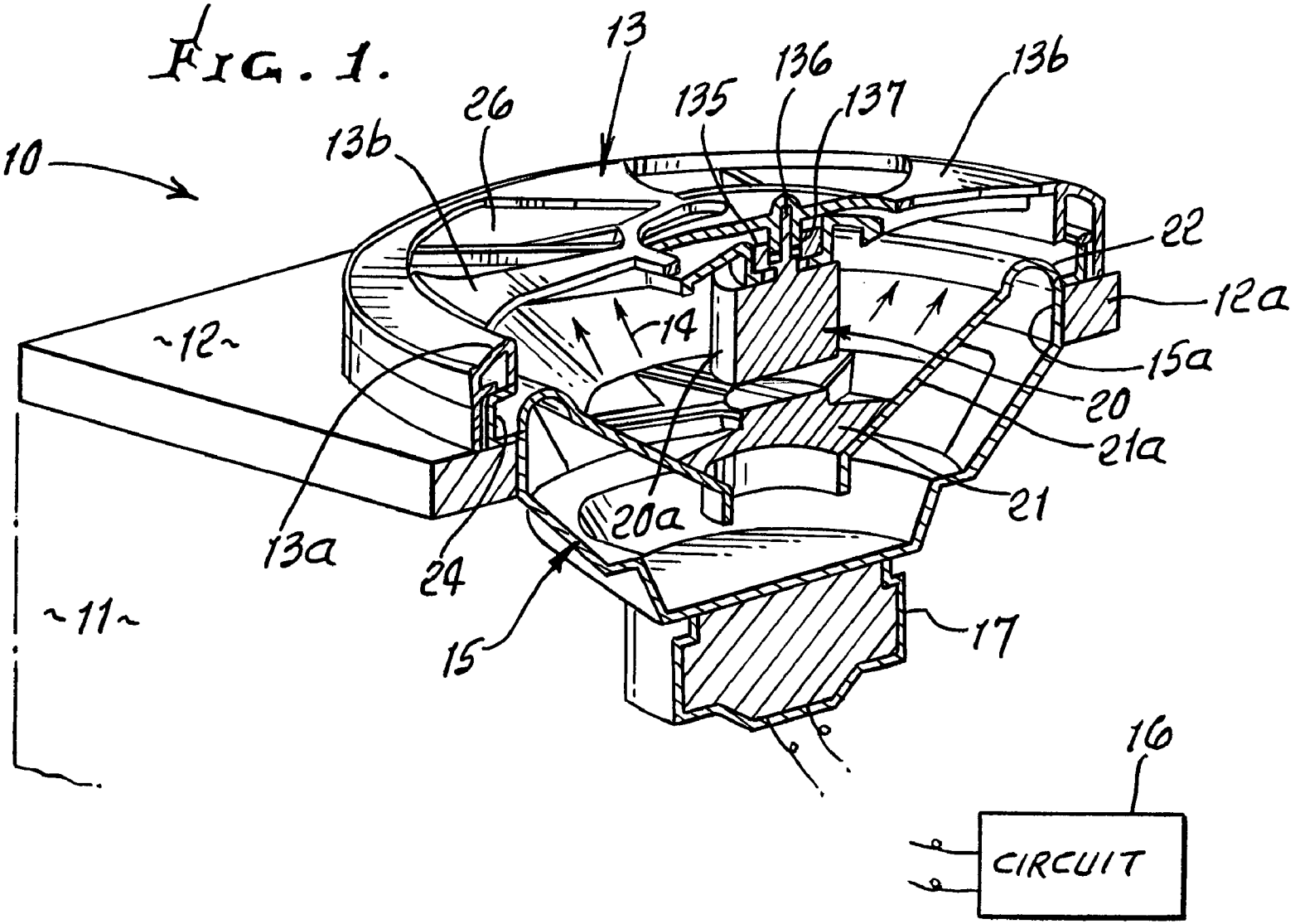
FIG. 1 is a cutaway perspective view of a preferred device incorporating the invention.

In the drawings, a loudspeaker assembly 10 includes a box 11 having a front plate 12. The box may comprise a housing for a speaker, as may be incorporated in or on a vehicle instrument panel.

Associated with plate 12 is a spinner 13 mounted to rotate in the path or paths (see arrows 14) of sound waves produced by a speaker diaphragm 15. A circuit to drive the diaphragm is indicated at 16, and an actuator mechanism at 17.

A rotary drive, such as an electric motor 20 is positioned, as between the diaphragm and spinner, to rotate the spinner. The drive housing 20*a*, is typically carried by a support 21, in the form of a stationary ring 21*a* peripherally carried at 22 by a mounting annular portion 12*a* of plate 12. The outer annular extent 15*a* of diaphragm 15 may also be carried by 12*a*. Annular portion 12*a* also carries an upstanding mounting ring 24 peripherally surrounded by the spinner, i.e. at outer edges of the spinner rim 13*a*.

Figure 2:
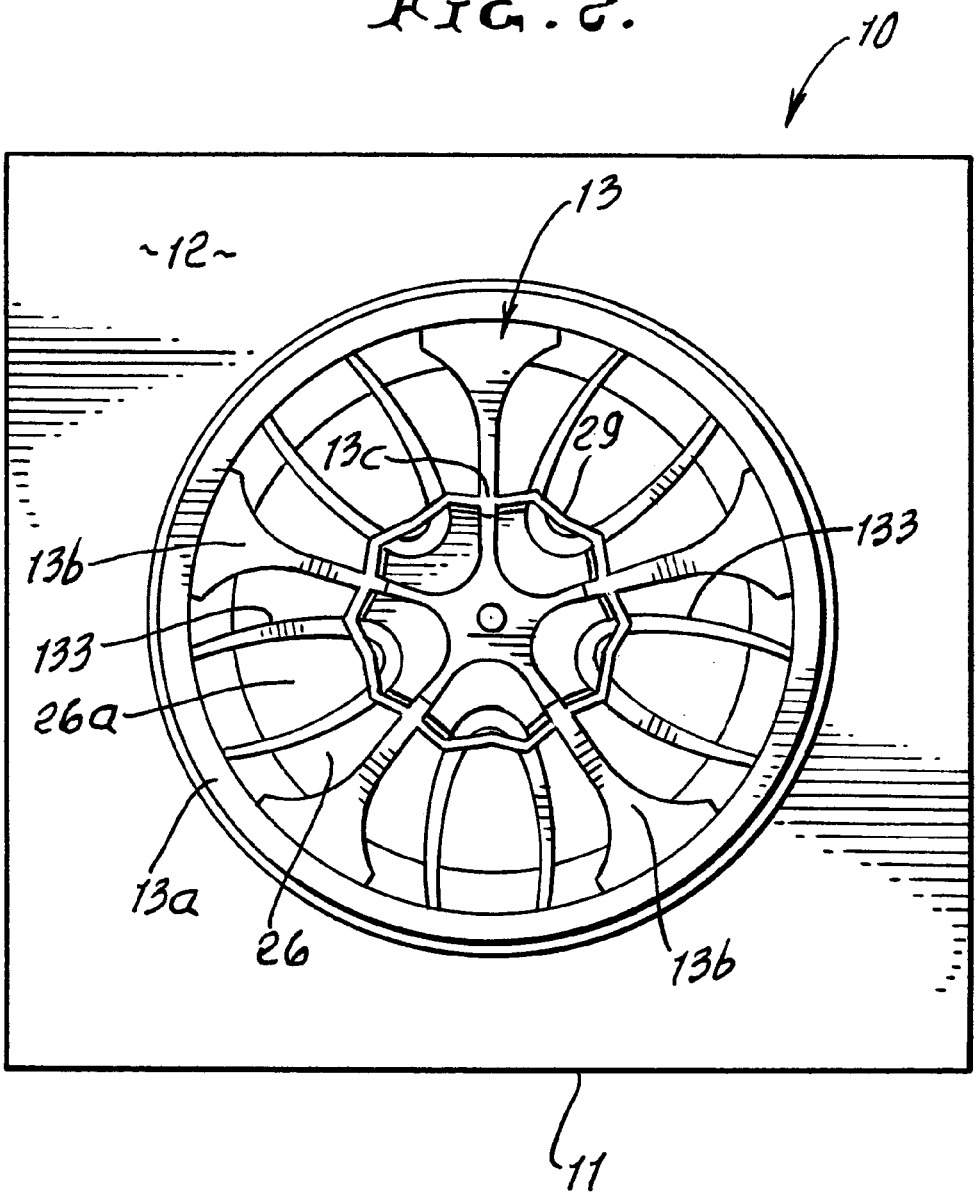
FIG. 2 is a top plan view of the FIG. 1 device.
Figure 3:
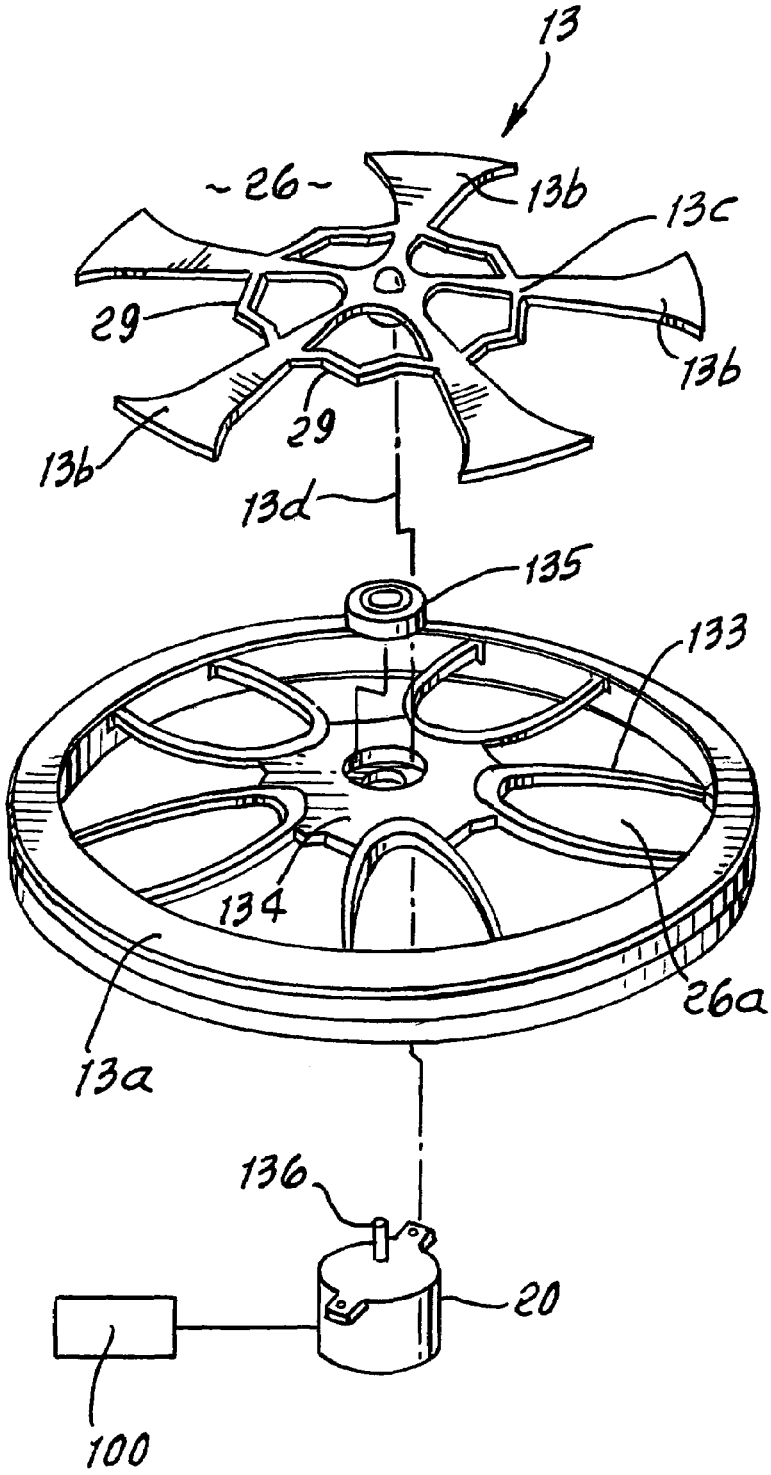
FIG. 3 is a perspective exploded view of the spinner and of a positioning ring.
Figure 4:
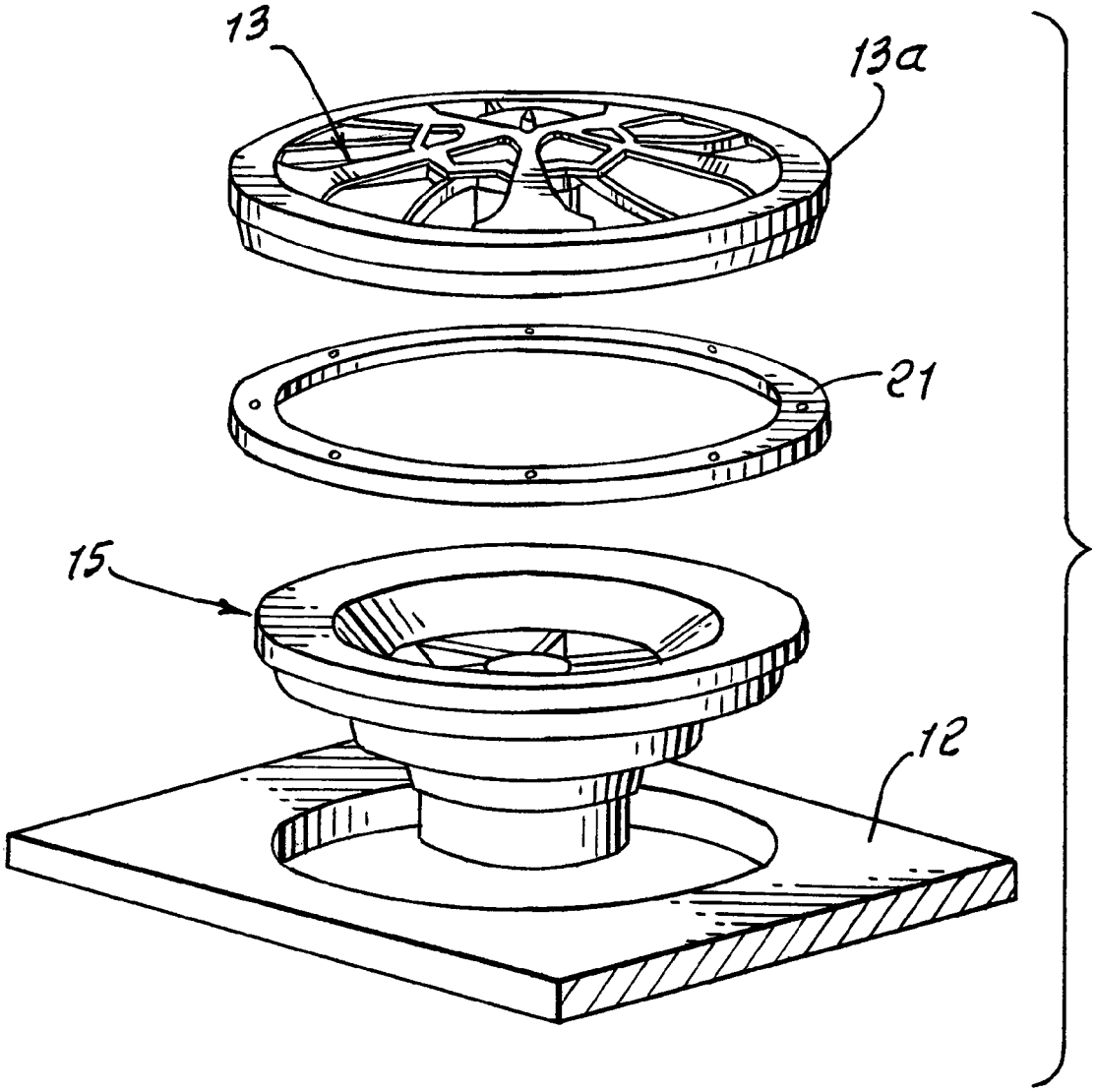
FIG. 4 is a perspective exploded view of the positioning ring, a mounting rim, and a loudspeaker diaphragm, as shown in FIG. 1.

Openings 26 are formed between the spaced apart arm 13*b* of the spinner, to pass sound waves produced by diaphragm 15 and directed through the spinner, which substantially spans, transversely, the path or paths of such waves 14. The arms 13*b* are preferably of widths which increase radially outwardly, as seen in FIG. 2. Narrow braces 29 interconnect successive arms, at their lesser widths extents 13*c*, outwardly of the spinner axis 13*d* of rotation, for safety. See also non-rotating arms 133 projecting generally radially and also forming openings 26*a* outwardly of a fixed hub 134. The latter carries a bearing 135 for the motor shaft 136 and sleeve 137, which carries the spinner. Arms 133 provided a fixed grille, 133*a*.

FIG. 1 shows drive shaft 136 projecting upwardly into the spinner sleeve. Annular bearing 135 is positioned between the spinner hub sleeve 137, which rotates, and hub 134 carried by the support 21.

In operation, the drive preferably rotates the spinner at a speed causing audible modulation of said sound waves passing through said openings between the arms, as by chopping. Such modulation is enhanced by the provision of the variable width spinner arms, as described. Note also the diaphragm 15, preferably a woofer, is generally concave toward the spinner. The drive is generally centrally located at an axis defined by the spinner, and supports the spinner for rotation, the drive located between the spinner and diaphragm.

A control 100 may be operatively connected to the motor 20, to vary its rotary speed, to vary the sound wave modulation effect. Control 100 may be manually controllable. The motor may be eliminated so that the spinner rotates in response to displaced air passage between arms 13*b* which may be angled, hub sleeve 137 rotating in bearing 135 carried in a well 134*a* formed by 134. FIGS. 1–4 show the preferred embodiment.

Figure 5:
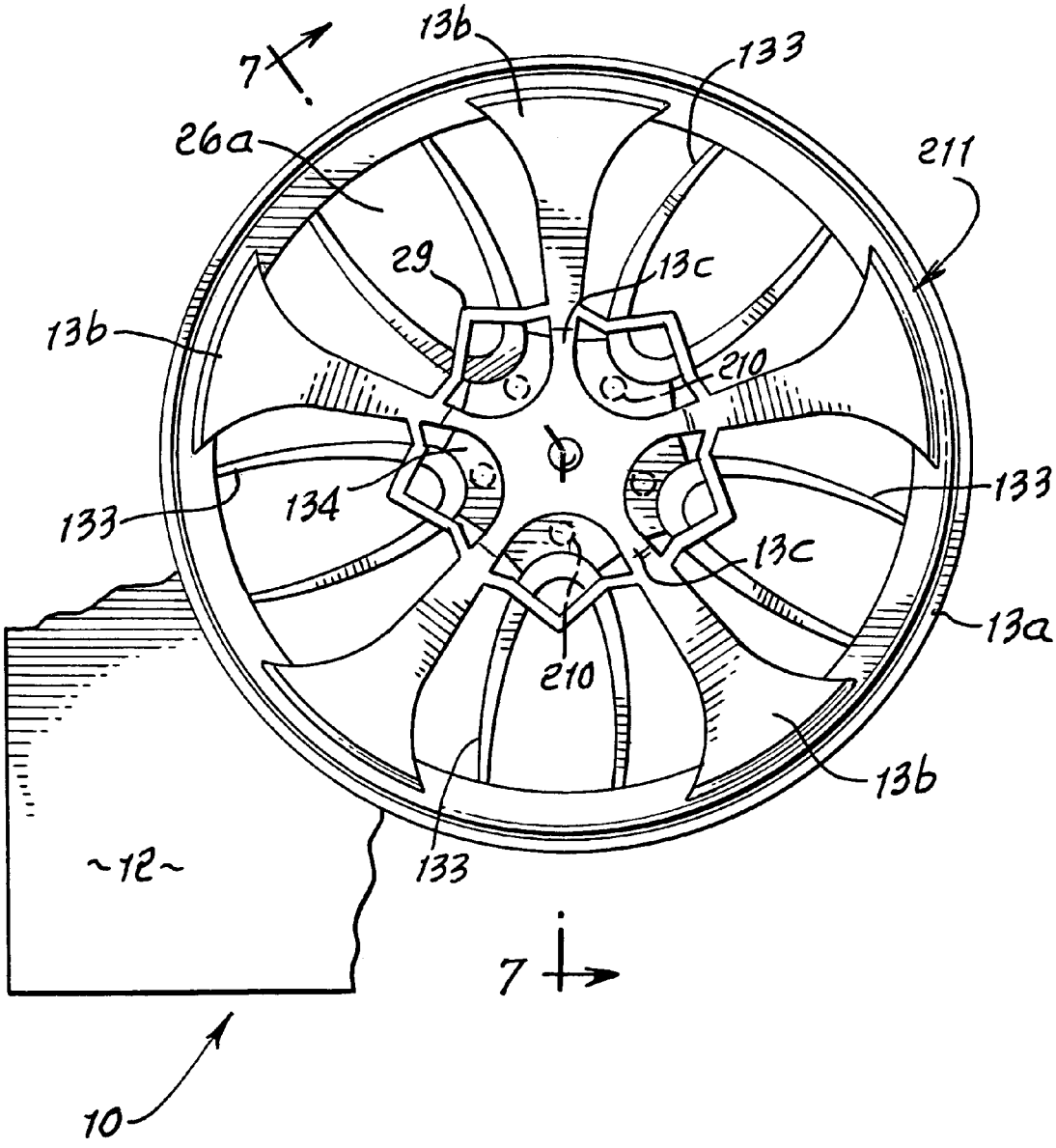
FIG. 5 is like FIG. 2, but shows a modification.
Figure 6:
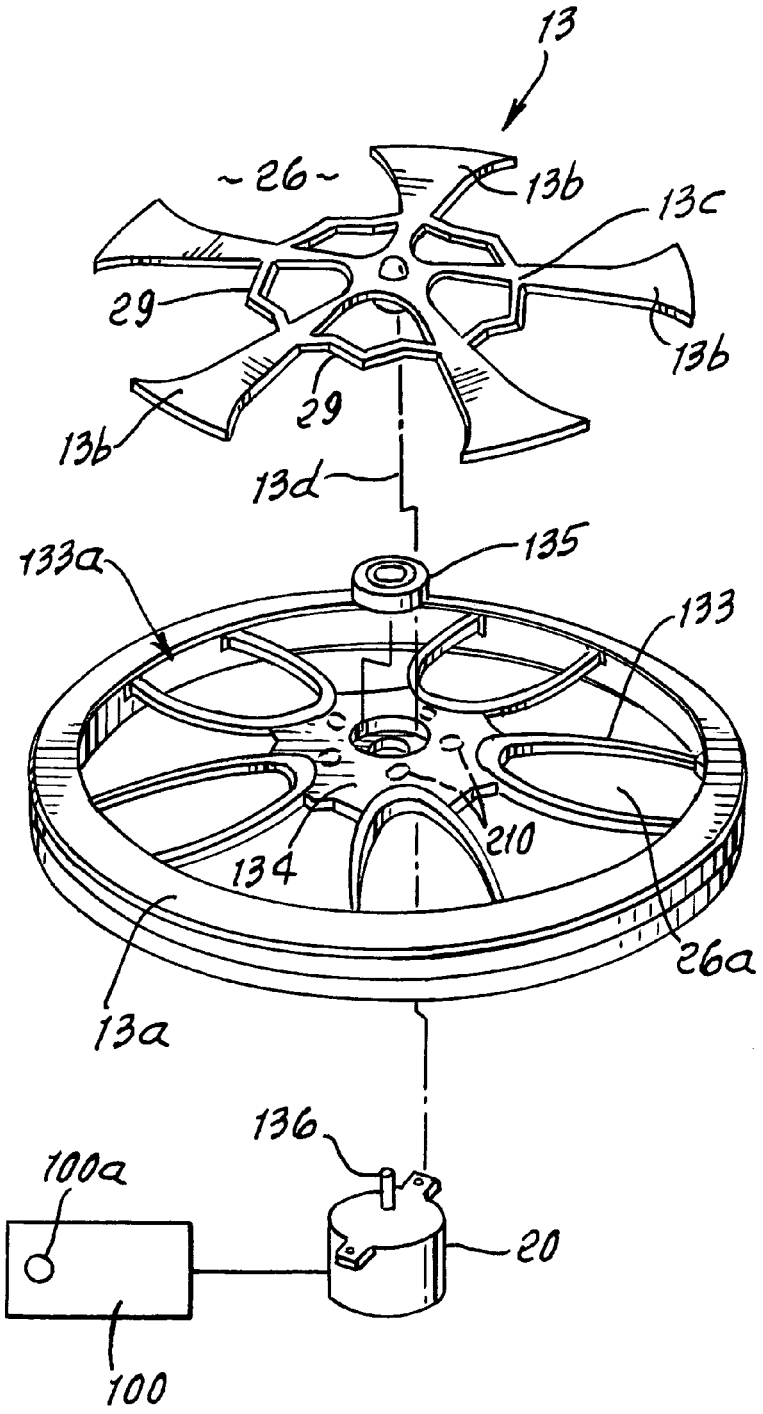
FIG. 6 is like FIG. 3, and shows the modification.
Figure 7:
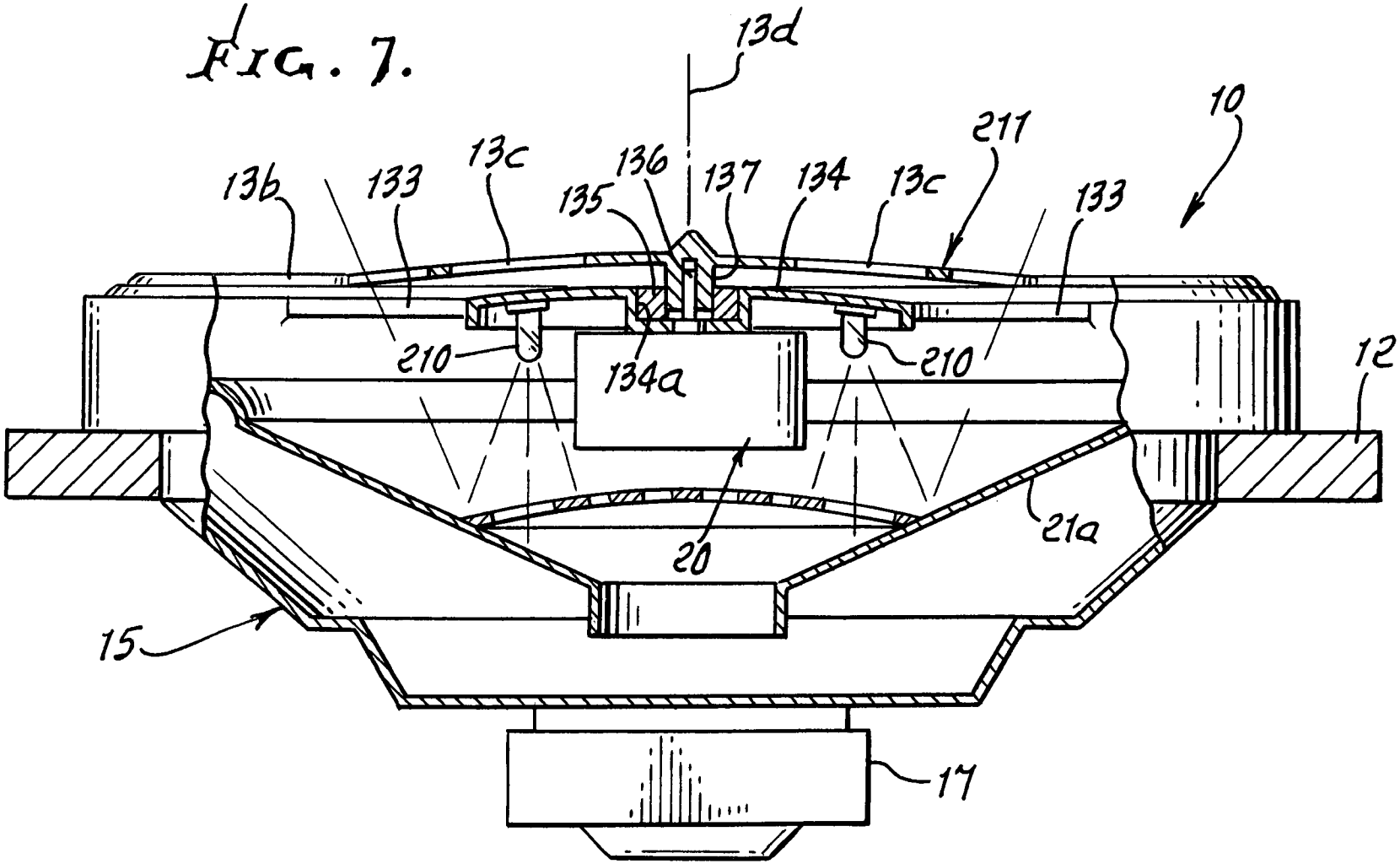
FIG. 7 is a section taken on lines 7—7 of FIG. 5.

A further feature of the invention is the provision of an LED or LEDs carried by non-rotating structure of spinner apparatus. In FIGS. 5–7, the LEDS 210 are carried by the fixed hub 134, in registration with the central spinning hub 211 and the inner narrower extents 13*c* of arms 13*b*. The LEDs may project in directions away from the spinner, so that their light illuminates interior structure including the diaphragm 15 visible through openings between rotating arms 13*b*, one effect being to produce an indirect light stroboscopic-like effect as rotating arms 13*b* cross over arms 133, and receive light reflected off the diaphragm. Control 100 includes a manual control 100*a* to increase or decrease the illumination; and the LEDs may produce light of different colors, for enhanced visual effect. All arms may be highly reflective, as by chrome plating application, to reflect indirect interior lighting chopped by the arms.

The spinner 13 may be removed, as for example by detachment of hub sleeve 137 from the motor driven shaft 136; and an alternate spinner can be applied to the shaft 136, as for production of different visual and auditory effects. The grille 133*a* may also be removable for replacement by a grille of a different arm design. Thus, different combinations for different effects can be easily provided, as for example:

| |
|---|
| Grille A + Spinner C |
| Grille A + Spinner D |
| Grille B + Spinner C |
| Grille B + Spinner D |
| etc. |

Spinner changes can easily be made by the vehicle occupant facing the vehicle dash, and pulling off and replacing the spinner, as desired.

We claim:

1. In combination with a loudspeaker assembly that includes a speaker diaphragm that is displaced to produce sound, the combination comprising a) a spinner, b) means mounting the spinner to rotate in the path of sound waves produced by the speaker diaphragm;

c) the spinner defining sound wave passing through openings, in said path d) said means including a releasable connection whereby selectable different spinners may be removably mounted for rotation, e) said spinner comprising i) a hub, and ii) spaced apart arms extending outwardly from said hub there being a LED or LEDs carried by a non-rotating structure associated with the spinner, the spinner located on the outer side of said non-rotating structure, remote from the diaphragm, f) said LED or LEDs being directed toward the diaphragm to produce light visible through the rotating spinner, and through a non-rotating grille defined by said non-rotating structure.

2. The combination of claim 1 wherein said light is directed to illuminate the diaphragm, visible through rotating and non-rotating openings defined by the spinner and grille.

3. The combination of claim 1 wherein said arms have spaced apart extents between which said openings are formed.

4. The combination of claim 3 wherein the arms have varying widths along arm lengths which extend generally radially.

5. The combination of claim 1 including a rotary drive for the spinner that comprises an electric motor positioned between said diaphragm and said spinner.

6. The combination of claim 5 wherein the drive rotates the spinner at a speed causing audible modulation of said sound waves passing through openings formed between the spinner arms.

7. The combination of claim 1 including a drive that comprises an electric motor positioned between said diaphragm and said hub, and operatively connected to the hub, to rotate the spinner.

8. The combination of claim 7 wherein the drive rotates the spinner at a speed causing varying width of the spinner arms to discernibly and audibly modulate sound waves passing through the openings formed between the arms.

9. The combination of claim 8 including said diaphragm that is generally concave toward the spinner arms.

10. The combination of claim 1 including a front plate defined by said assembly, the plate defining an aperture in alignment with said openings and the diaphragm.

11. The combination of claim 10 including an interior support carried by the plate and carrying a drive.

12. The combination of claim 1 wherein a spinner drive is generally centrally located at an axis defined by the spinner, and supports the spinner for rotation, the drive located between the spinner and diaphragm.

* * * * *